US005524966A

United States Patent [19]

Piretti

[11] Patent Number: 5,524,966

[45] Date of Patent: Jun. 11, 1996

[54] FOLDING CHAIR WITH TILTING BACKREST

[75] Inventor: Giancarlo Piretti, Bologna, Italy

[73] Assignee: Pro-Cord S.r.l., Bologna, Italy

[21] Appl. No.: 346,248

[22] Filed: Nov. 23, 1994

[30] Foreign Application Priority Data

May 27, 1993 [IT] Italy ..... TO93A0364

[51] Int. Cl.[6] ..... A47C 4/10

[52] U.S. Cl. ..... 297/301.3; 297/55; 297/48

[58] Field of Search ..... 297/16.1, 19, 21, 297/29, 48, 52, 55, 291, 299, 301.3, 303.3

[56] References Cited

U.S. PATENT DOCUMENTS 2,282,109 5/1942 Angell ..... 297/21 X 3,705,744 12/1972 Piretti et al. ..... 297/55

4,441,757 4/1984 Gasca Burges ..... 297/55

4,938,532 7/1990 Burgess ..... 297/291 X 5,100,201 3/1992 Beeker, III et al. ..... 297/306 X

*Primary Examiner*—Peter R. Brown

*Attorney, Agent, or Firm*—Sughrue, Mion, Zinn, Macpeak & Seas

[57] ABSTRACT

A folding chair is provided with three structures respectively defining the front legs, the rear legs and the seat which are reciprocally articulated around a common axis. The backrest of the chair forms part of a fourth structure separate from said three structures and articulated on one of them around the common axis. IN the condition of use of the chair, the backrest can be tilted backwardly against the action of a spring.

5 Claims, 5 Drawing Sheets

FOLDING CHAIR WITH TILTING BACKREST

BACKGROUND OF THE INVENTION

The present invention relates to folding chairs of the type comprising:

a first structure defining the front legs of the chair, a second structure defining the rear legs of the chair, a third structure defining the seat of the chair, and a backrest, wherein:

a) said three structures are provided with means for reciprocal articulation around a common axis, b) said means for reciprocal articulation includes stop means which limit the angular movement of each of said structure with respect to another one of said structure, so that the chair is able to assume a flattened folded condition and an unfolded condition of use.

A chair of the above indicated type is described and illustrated in U.S. Pat. No. 3,705,744 of the same inventor. In the known chair illustrated in this document, the backrest is rigidly connected to the front legs and therefore it forms an integral part of said first structure defining the front legs. More specifically, in the known solution, the backrest and the front legs of the chair are defined by a single rectangular frame, whereas the rear legs are defined by a U-shaped frame arranged inside the rectangular frame. Finally, the seat is defined by a further structure arranged inside the U-shaped frame, the above mentioned three structures being articulated to each other around said common axis by means of two side hinges. Each of said hinges is provided with stop means. Such stop means allow the seat to rotate with respect to the U-shaped frame from a position coplanar therewith to a position defining an angle with respect to the U-shaped frame. The U-shaped frame on its turn can rotate with respect to the rectangular outer frame from a position coplanar therewith to a position defining an angle therewith. In this manner, the above mentioned known chair can assume a fully folded flattened position as well as an unfolded position for use. At the same time, when the rectangular frame and the U-shaped frame are in their opened position, corresponding to the condition in which the chair is able to stand stably on the floor, the seat may be rotated from a condition for use to a raised condition, to make the passage easier for people walking between two subsequent rows of chairs.

The above mentioned known chair is therefore of convenient and effective use while at the same time having an extremely simple and reliable structure which is also aesthetically appealing.

SUMMARY OF THE INVENTION

The object of the present invention is that of improving the above described known chair, keeping all the advantages thereof, but enhancing at the same time its features, with particular regard to seating comfort.

In view of achieving this object, the invention provides a folding chair, comprising a first structure defining the front legs of the chair, a second structure defining the rear legs of the chair, a third structure defining the seat, and a backrest, in which:

a) said three structures are provided with means for reciprocal articulation around a common axis, b) said means for reciprocal articulation includes stop means which limit the angular movement of each of said structures with respect to another one of said structures, so that the chair is able to assume a flattened folded condition and an unfolded condition for use, characterised in that:

c) said backrest is defined by a fourth structure separate from said three structures and pivotally mounted on one of these three structures around said common axis, d) there are provided spring means to oppose a rotation of said fourth structure causing a backward tilting movement of the backrest, and e) there are provided auxiliary stop means which limit the backward tilting movement of said backrest.

Due to such features, the chair according to the invention achieves various advantages at the same time: on one hand it has a structure which is very simple and can be manufactured at low cost; on the other hand, it can be moved from the condition for use to the folded condition by very simple and quick operations. In said folded condition, the chair has a minimum bulk and can be arranged with other chairs of the same type also in their folded conditions, so as to allow them to be stocked in a minimum space. Finally, in the condition for use, the chair achieves a very high comfort for the user, due to the elastically biased tilting backrest. Such features render the chair according to the invention particularly adapted to be used in public places or conference or meeting rooms and the like.

According to a further preferred feature of the invention, said spring means comprise at least a torsion spring arranged along the common articulation axis of said four structures forming the chair and connected to one side of said fourth structure, of which the backrest forms a portion. Preferably, there are provided two torsion springs connected to the two sides of said fourth structure. Finally, according to a further preferred feature of the invention, said two torsion springs are formed by a single leaf spring arranged along the articulation axis of the chair, held at its centre by one of said first and second structures and connected at its ends to the two sides of said fourth structure.

Due to said further features, the advantageous results which have been mentioned above with reference to the seating comfort provided by the chair according to the invention are made possible by a structure which is exceptionally simple and of reduced dimensions.

BRIEF DESCRIPTION OF THE DRAWINGS

Further features and advantages of the invention will become apparent from the following description with reference to the annexed drawings, given purely by way of non limiting example, in which.

DETAILED DESCRIPTION OF THE INVENTION

Figure 2:
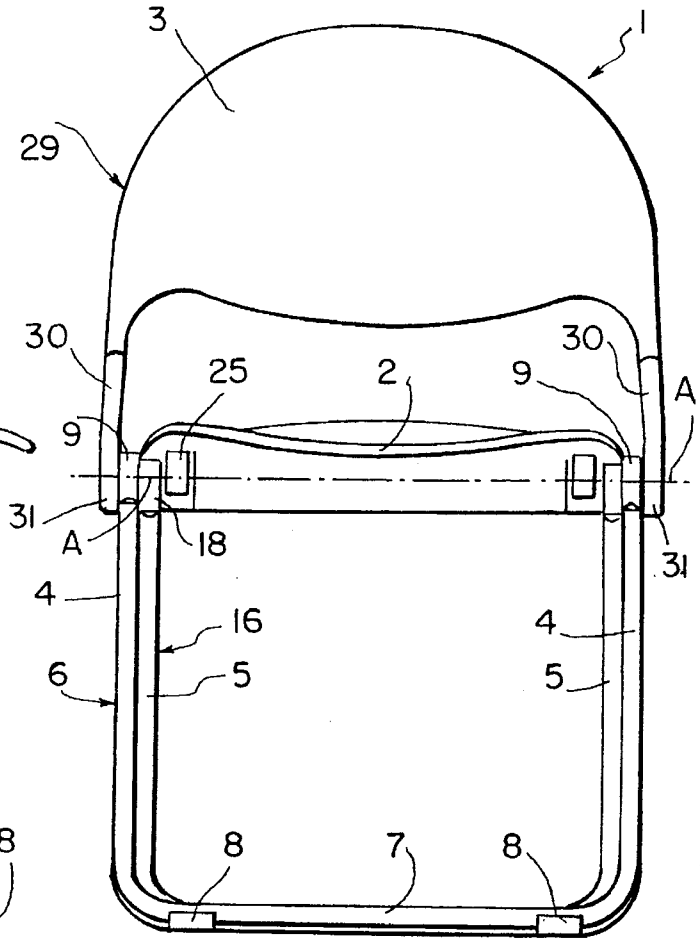
FIG. 2 is a front view of the chair of FIG. 1.

In the drawings, reference numeral 1 generally designates a folding chair comprising a seat 2, a backrest 3, a pair of front legs 4 and a pair of rear legs 5.

The two front legs 4 form part of a first structure 6 which is U-shaped and has a central portion 7 for rest on the floor, and provided to this end preferably with two feet 8, for example made of rubber. The U-shaped structure 6 comprises two side portions defining the front legs 4 and ending at their free ends with two hubs 9 which are rigidly connected, in a way which will be described hereinafter, to the ends of a tube 10 (see FIGS. 4, 5), which is preferably made of sheet metal, whose axis is indicated by A.

Figure 4:
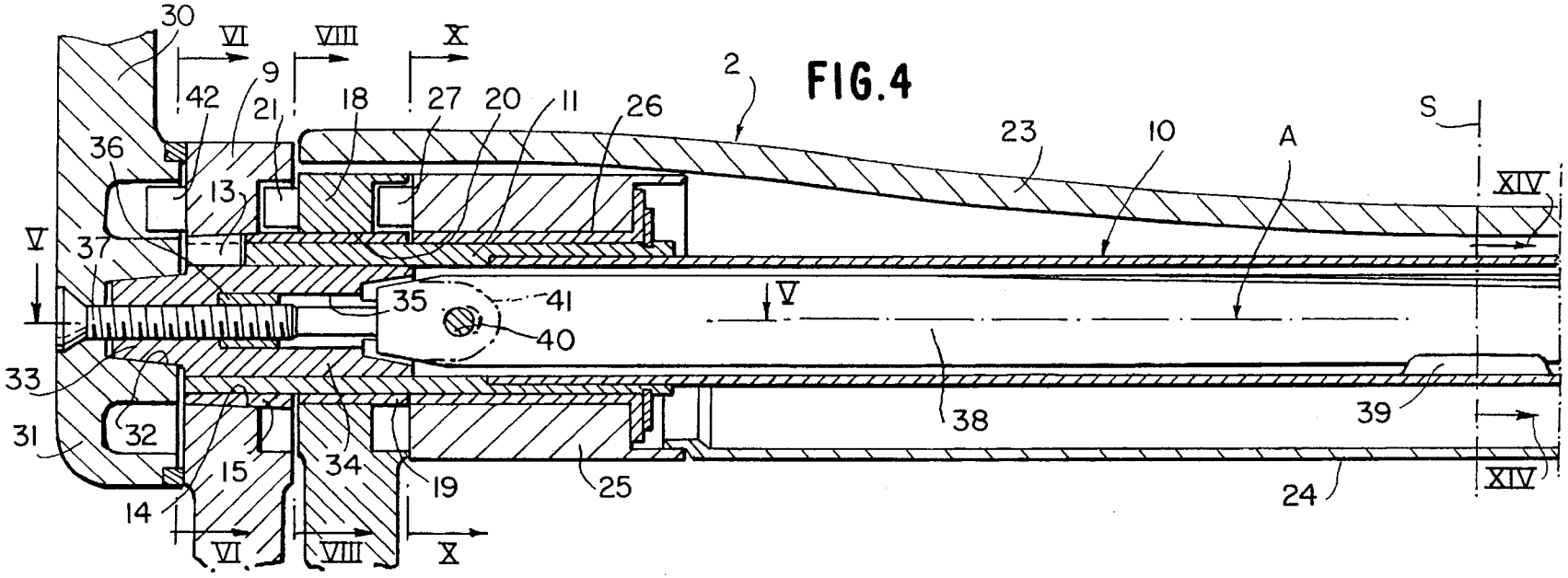
FIG. 4 is a partial view on an enlarged scale and in cross section, taken along line IV—IV of FIG. 1.
Figure 5:
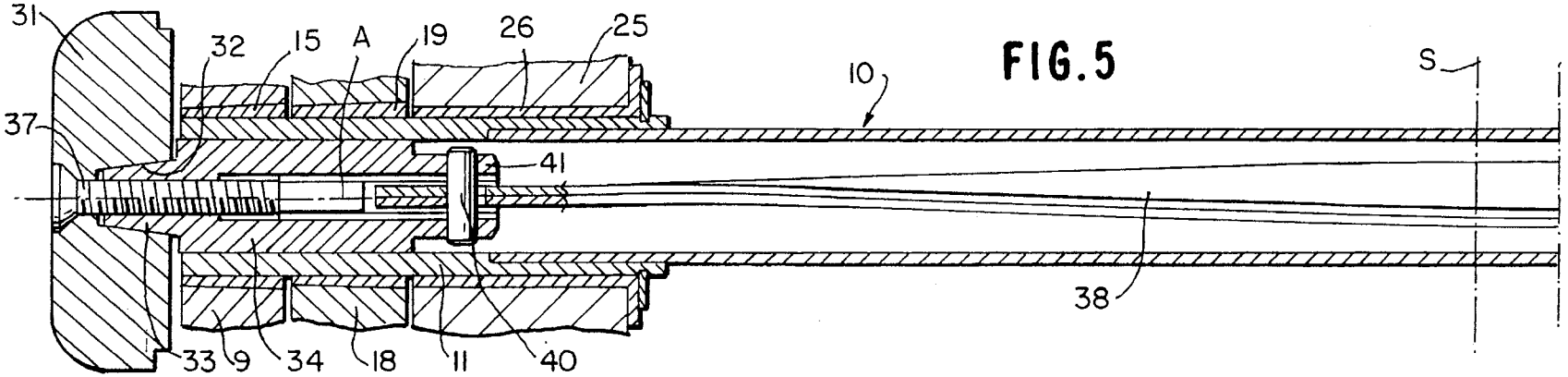
FIG. 5 is a cross-sectional view taken along line V—V of FIG. 4.
Figure 12:
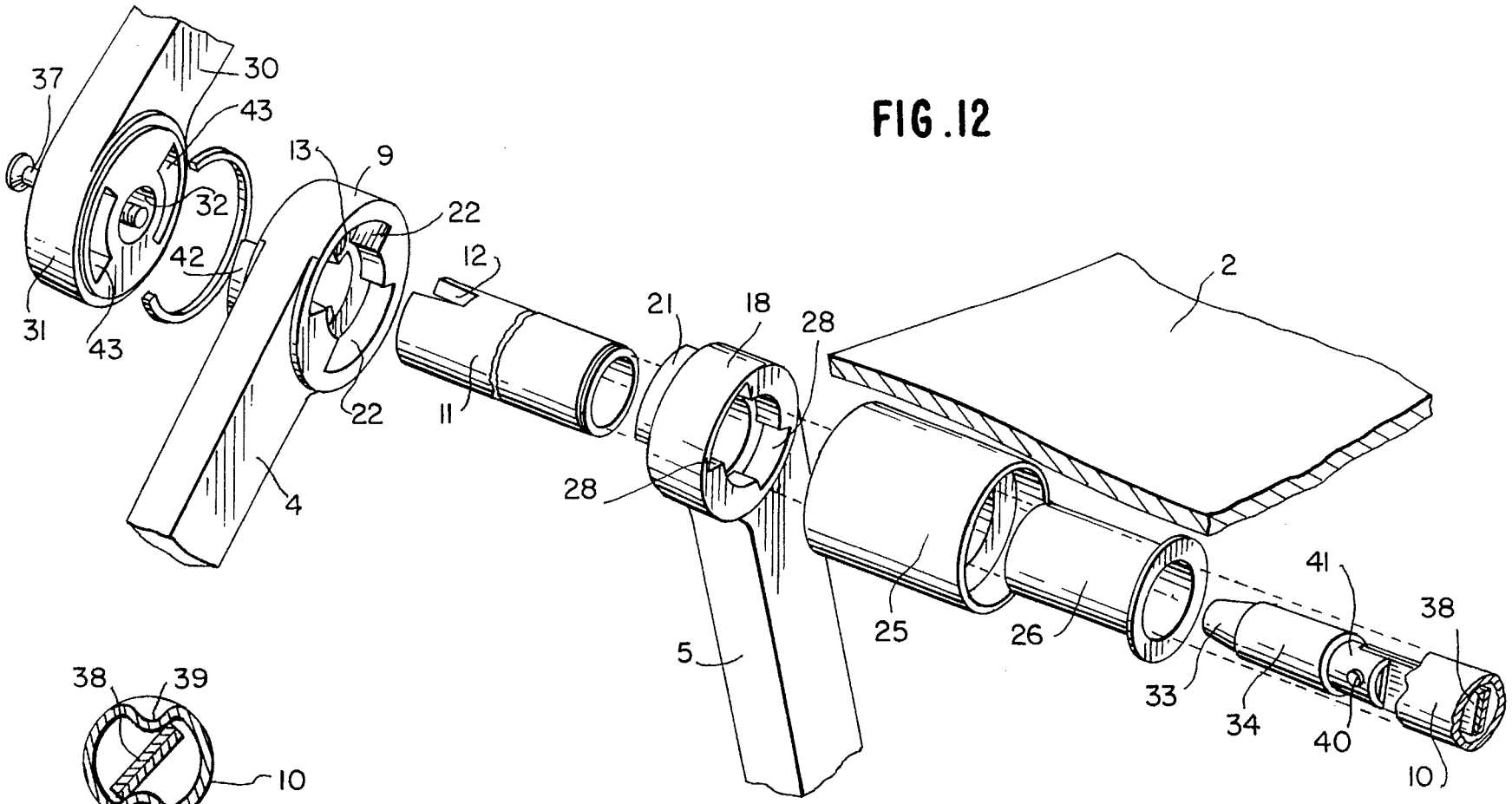
FIGS. 12, 13 are two perspective exploded views of the detail shown in FIGS. 6–11.

With specific reference to FIGS. 4, 5 and 12, each end of the sheet metal tube 10 (only one of such ends is visible in FIGS. 4, 5, the part of the chair which is not visible in these figures being symmetrical to that shown with respect to a vertical plane of symmetry of the chair, indicated by S) is rigidly connected to a bush 11 whose end is on its turn rigidly connected to the respective bush 9 of the respective front leg 4. As it is clearly apparent from FIG. 12, the outer end of each bush 11 has two notches 12 (only one of which is visible in FIG. 12) which are diametrically opposed to each other, and are engaged by two teeth projecting radially from the central hole 14 of hub 9. The outer end of the bush 11 is snugly fit into hole 14, with the interposition of a bush 15, for example made of nylon, also having notches corresponding to notches 12 of bus 11. Bush 15 is conical outside so that it can adapt to the shape of hole 14 of hub 9 which is also conical for purposes of manufacture. The structure 6 is indeed preferably a metal structure obtained by casting and the conical shape of hole 14 originates from the need of permitting withdrawal of the piece from the mould during manufacture. Because of the above described arrangement, the two hubs 9 of U-shaped structure 6 defining the front legs 4 are rigidly connected to the ends of the sheet metal tube 10.

Figure 1:
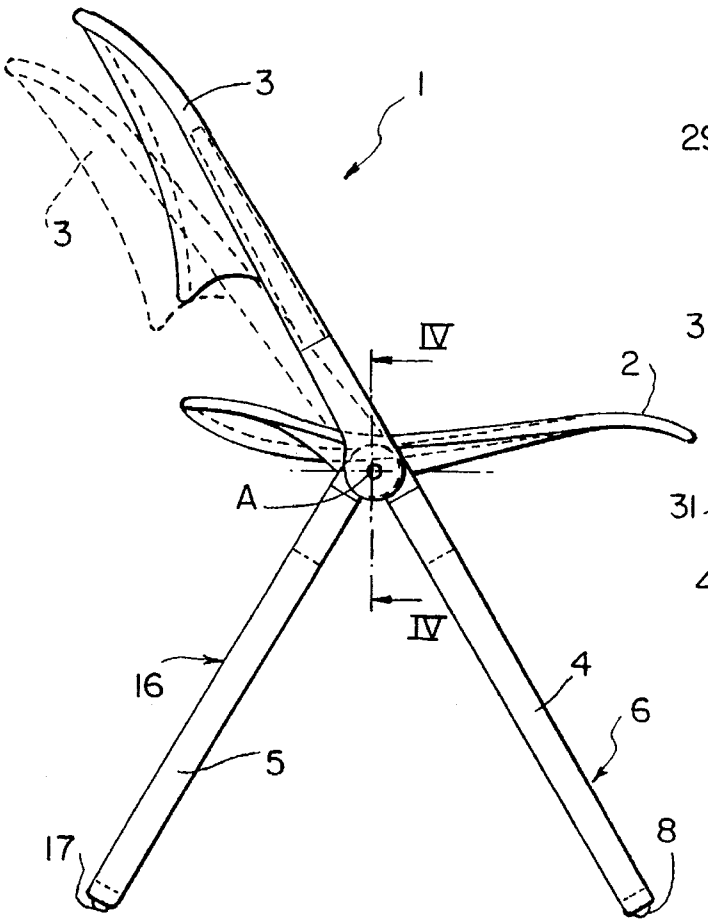
FIG. 1 is an elevational side view of the chair according to the invention in the condition of use.

In FIGS. 1, 2, reference numeral 16 designates a second U-shaped structure which is also preferably made of metal by casting, whose side portions define two rear legs 5 and whose central portion is preferably provided with feet 17 (FIG. 1) for example made of rubber similar to feet 8 of portion 7 connecting the front legs 5. Also the rear legs 5 have at their free ends hubs 18 which are freely rotatably mounted on the two bushes 11 (FIGS. 4, 5) each with the interposition of a bush of nylon 19 having a conical outer surface with a shape corresponding to that of central hole 20 of hub 18, for the same reason seen above with reference to bush 15 and hole 14 of hub 9. Due to the above described arrangement, the structure 16 defining the rear legs 5 is freely articulated with respect to the structure 6 defining the front legs 4 around the axis A of the sheet metal tube 10. The relative rotation between such structures however is not free, but is limited between two end positions defined by stop means which now will be described.

As more clearly illustrated in FIGS. 4, 8, 9 and 12, 13, each hub 18 has on its front surface facing the respective hub 9, two axially projecting arcuate sectors 21, corresponding to circle arcs having their centre on axis A and freely slidably received within corresponding circumferential grooves 22 formed in the opposite face of hub 9.

The end surfaces of each arcuate sector 21 are able to come selectively in contact with the end surfaces of the corresponding arcuate groove 22, which therefore act as stop surfaces able to define the two end positions of the relative rotation between hub 18 and hub 9. As clearly apparent in FIGS. 8, 9, one of these positions (FIG. 8) corresponds to the opened diverging condition of front and rear legs 4, 5, which on its turn corresponds to the unfolded condition of use of the chair.

The opposite end position (FIG. 9) corresponds to the folded condition of the front and rear legs 4, 5, in which such legs are arranged side by side and parallel to each other.

Figure 10:
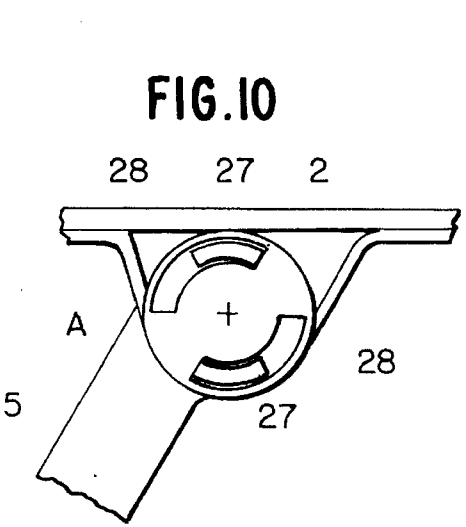
FIG. 10 is a partial view and in cross section taken along line X—X of FIG. 4.
Figure 11:
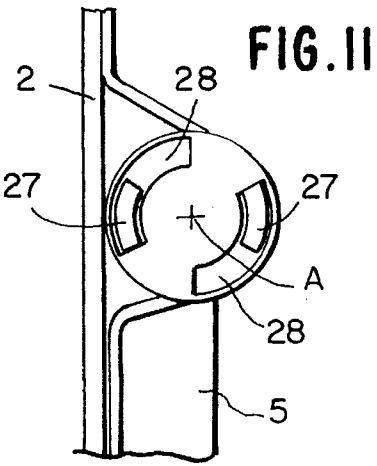
FIG. 11 shows the cross section of FIG. 10 in the folded condition of the chair.

A structure of the seat of the chair according to the invention comprises an upper panel 23 (FIG. 4) and a lower panel 24 which are connected to two side bushes 25 (only one of which is visible in the drawings). The lower panel 24 blocks the view of the sheet metal tube 10. Bush 25 is rotatably mounted on bush 11 with the interposition of a further nylon bush 26. Therefore, the seat structure is pivotally mounted with respect to the sheet metal tube 10 connected to the front legs 4 around the axis A. Also in this case, said relative rotation is limited between two opposite end positions defined by the engagement of said arcuate sectors 27 projecting from the front surface of bush 25 which faces the respective hub 18 within two circumferential grooves 28 of this hub. FIGS. 10, 11 show the two end positions, corresponding to the unfolded condition of the chair and the folded condition, in which the seat is arranged vertically. Naturally, while leaving front and rear legs 4, 5 in a diverging position, it is possible to rotate seat 2 around axis A until it is disposed in a raised position in which for example the passage of people between two adjacent rows of chairs is made easier.

The backrest 3 of the chair forms part of a fourth structure 29 which is separate from structure 6 forming the front legs, from structure 16 forming the rear legs and from the structure of the seat 2. As clearly apparent in FIG. 2, structure 29 includes two side arms 30 ending with hubs 31 which also are pivotally supported by bushes 11 around axis A. With reference to FIGS. 4, 5 and 12, 13, each bush 31 has on its side facing the adjacent hub 9 a conical cavity 32 in which there is received the end conical portion 33 of a cylindrical body 34. Body 34 has an axial hole 35 in which there is received a nut 36 which abuts against an annular step of hole 35. Nut 36 is engaged by a screw 37 which crosses hub 31 and locks the conical end 33 of body 34 within cavity 32. Body 34 is rotatably supported around axis A within bush 11. The rotation of backrest 3 around the axis A however is not free, but is opposed by spring means comprising a leaf spring 38 (which in the illustrated example is formed by two juxtaposed metal leaves) arranged within the sheet metal tube 10. The leaf spring 38 extends throughout the length of tube 10 and is centrally held by two inwardly radially deformed portions of the wall of tube 10, indicated by 39 in FIG. 14. Each end of leaf spring 38 is instead connected by a transverse pin 40 to one end 41 of body 34, opposite to the conical end portion 33.

Figure 6:
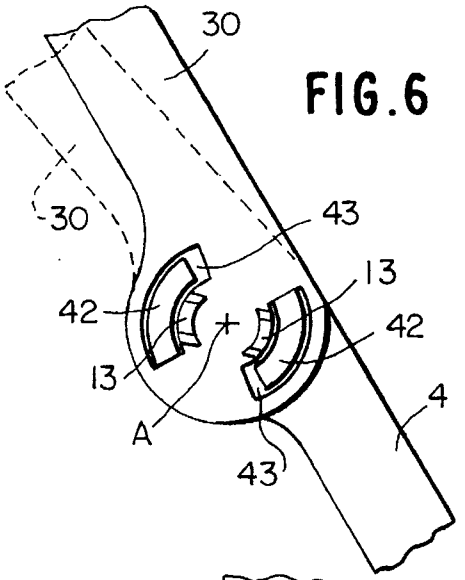
FIG. 6 is a partial cross-sectional view taken along line VI—VI of FIG. 4, in the condition of use of the chair.
Figure 7:
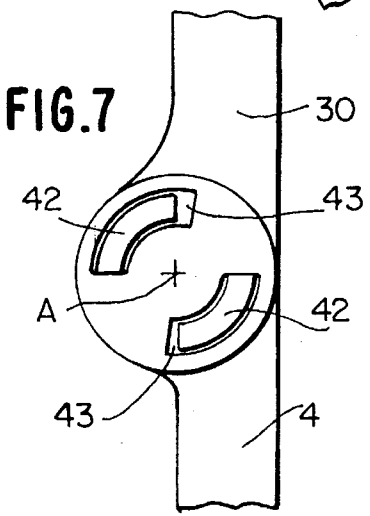
FIG. 7 shows the cross section of FIG. 6 in the folded condition of the chair.
Figure 8:
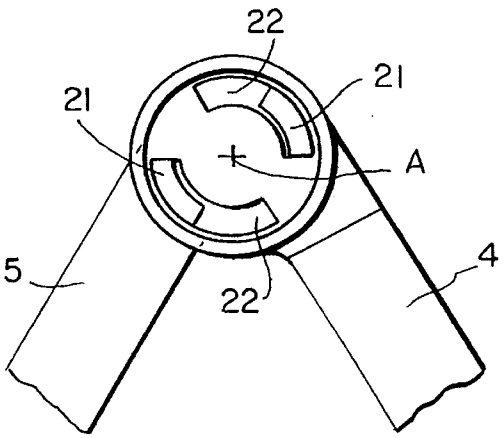
FIG. 8 is a partial view and in cross-section taken along line VIII—VIII of FIG. 4.
Figure 9:
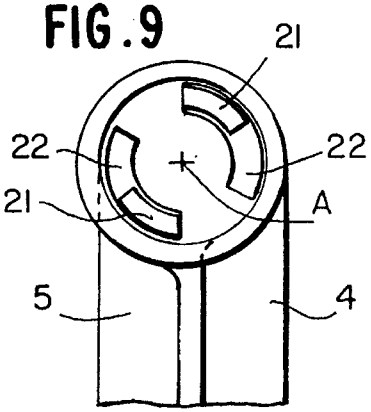
FIG. 9 shows the cross section of FIG. 8 in the folded condition of the chair.
Figure 14:
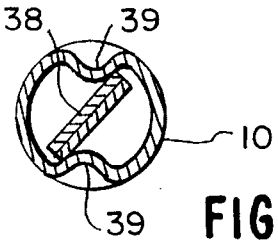
FIG. 14 is a cross-section taken along line XIV—XIV of FIG. 4.

With reference to FIG. 14, the two deformed portions of the sheet metal tube 10 prevent a rotation of the central part of the leaf spring 38 in an anti-clockwise direction (with reference to FIG. 14, i.e. in the direction corresponding to a backward tilting movement of backrest 3). Therefore, when backrest 3 is moved backwardly by rotating hubs 31 around axis A, this rotation is opposed by the leaf spring 38. In this condition, the central part of the leaf spring 38 is fixed and the two half portions of the leaf spring act as torsion bars able to oppose the tilting movement of the two arms 30 supporting the backrest 3. Said backward tilting movement of the backrest is also limited between two end positions which are defined by the engagement of the two arcuate sectors 42 (see FIGS. 4, 6, 7, 12, 13) formed on the front surface of each hub 9 facing the respective hub 31, within corresponding circumferential grooves 43 formed in the front surface of hub 31 facing hub 9. As it is clearly visible in FIGS. 6, 7, which show the relative position of arms 30 of the backrest and front legs 4 of the chair respectively in the condition for use and in the folded condition of the chair, the difference in angular extension between circumferential grooves 43 and arcuate sectors 42 correspond to the angular extension of the backward tilting movement which is possible to impart to backrest 3. In FIGS. 1 and 6, the backward reclined end position of the backrest 3 is also indicated with dotted line. When the backrest 3 is in its upright position (shown with undotted line in FIG. 6) a further forward tilting movement is not prevented by spring 38 (whose central portion illustrated in FIG. 14 could rotate with respect to tube 10 in a clockwise direction) but is prevented by the engagement of arcuate sectors 42 against the corresponding end surfaces of circumferential cavities 43.

Figure 3:
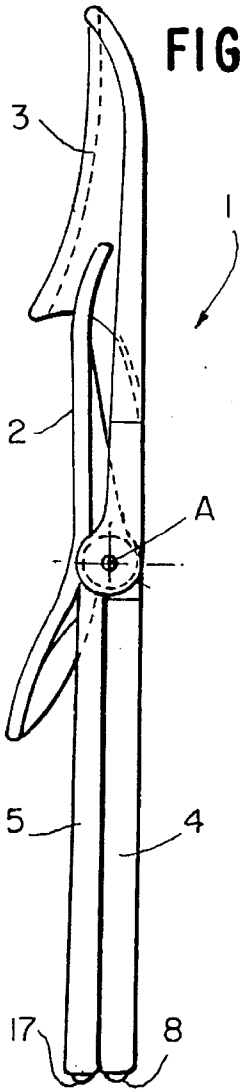
FIG. 3 is an elevational side view of the chair of FIG. 1 in the folded condition.
Figure 15:
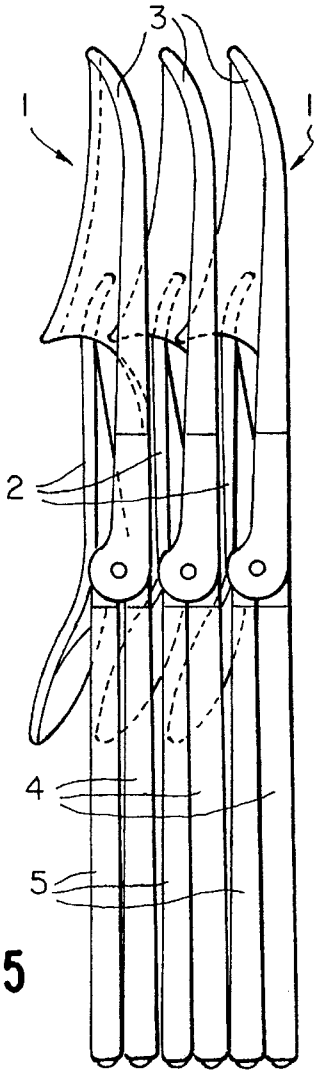
FIG. 15 is a side elevational view which shows three chairs according to the invention arranged in front of each other in their folded condition.
Figure 13:
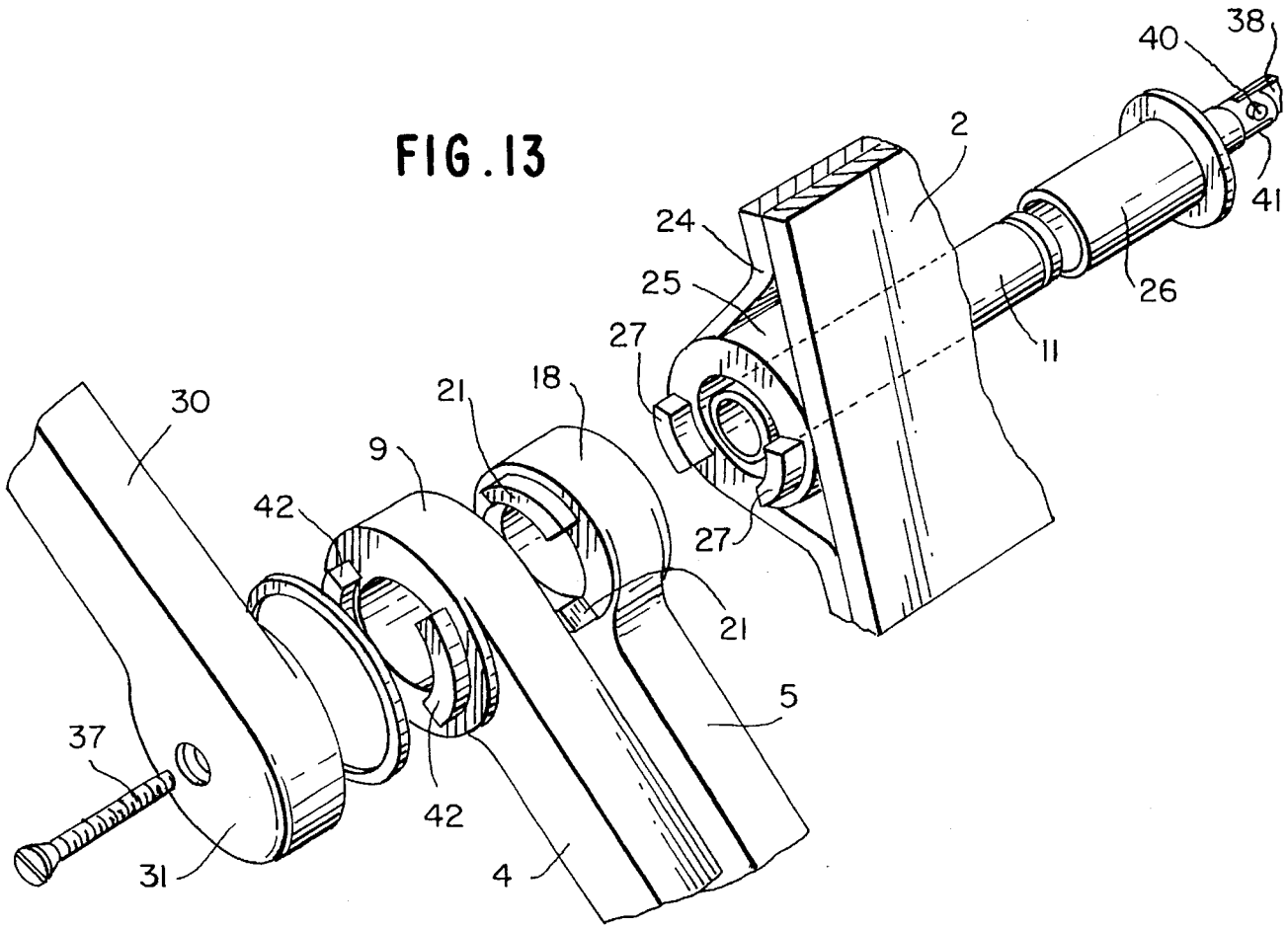

FIG. 3 clearly shows the reduced dimension of the chair according to the invention in the folded condition, and FIG. 15 shows how a plurality of chairs 1 according to the invention can be arranged in their folded condition in front of each other so as to occupy a minimum overall space, due to the reciprocal penetration of backrests 3 and seats 2.

As it is clearly apparent from the foregoing description, the chair according to the invention combines advantages of simple construction and effective operation with those of a very high comfort for the user.

Obviously, the spring means used for opposing the backward tilting movement of the backrest could be also different from those illustrated purely by way of example in the annexed drawings. For example, it would be possible to provide two springs of any other type at hubs 31, including also the case of two damping rubber supports with a torsion effect.

Naturally, while the principle of the invention remains the same, the details of construction and the embodiments may widely vary with respect to what has been described and illustrated purely by way of example, without departing from the scope of the invention.

What is claimed is:

1. Folding chair, comprising a first structure defining the front legs of the chair, a second structure defining the rear legs of the chair, a third structure defining the seat, and a backrest, in which:

a) said three structures are provided with means for reciprocal articulation around a common axis, b) said means for reciprocal articulation include stop means interposed between said three structures which limit the angular movement of each of said structures with respect to another one of said structures, so that said chair is able to assume a folded flattened condition and an unfolded condition for use, wherein:

c) said backrest is defined by a fourth structure separate from said three structures and pivotally mounted on one of said three structures around said common axis, d) spring means are provided between said fourth structure and said one of three structures to oppose a rotation of said fourth structure corresponding to a backward tilting movement of the backrest, and e) auxiliary stop means are provided between said fourth structure and said one of said three structures which limit the angular movement of said fourth structure with respect to said structure on which said fourth structure is pivotally mounted.

2. Chair according to claim 1, wherein said spring means comprise two torsion springs arranged along said common axis and each having one end operatively connected to said structure on which said fourth structure is pivotally mounted and the opposite end connected to a respective side arm forming part of said fourth structure.

3. Chair according to claim 2, wherein said torsion springs are formed by a single leaf spring having the central portion operatively connected to said structure on which said fourth structure is pivotally mounted and its ends respectively connected to said two side arms of said fourth structure.

4. Chair according to claim 3, wherein said first structure has a U shape with ends forming two hubs which are rigidly connected to the ends of a tube arranged along said axis, said second structure having also a U shape and having its ends forming two hubs rotatably mounted on the ends of said tube, said third structure being also rotatably mounted on said tube and said fourth structure being also rotatably mounted on said tube, said stop means comprising first stop means interposed between each hub of said first structure and the respective hub of said second structure, second stop means interposed between each hub of said second structure and said third structure and third stop means interposed between each hub of said first structure and a respective side hub of said fourth structure including the backrest.

5. Chair according to claim 4, wherein each side hub of said fourth structure including the backrest is rigidly connected to a cylindrical body which is rotatably mounted within the respective end of said tube and connected to a respective end of said leaf spring, said leaf spring having its central portion held by two inwardly radially deformed portions of the tube, against rotations corresponding to a backward tilting movement of the backrest.

* * * * *